US007749007B1

(12) United States Patent
Gilliam

(10) Patent No.: US 7,749,007 B1
(45) Date of Patent: Jul. 6, 2010

(54) MICRO SWITCH POWER CONNECTOR

(76) Inventor: Charles David Gilliam, 19423 Indian Ridge, Baton Rouge, LA (US) 70817

( * ) Notice: Subject to any disclaimer, the term of this patent is extended or adjusted under 35 U.S.C. 154(b) by 0 days.

(21) Appl. No.: 12/434,044

(22) Filed: May 1, 2009

(51) Int. Cl.
*H01R 29/00* (2006.01)

(52) U.S. Cl. ..... 439/188

(58) Field of Classification Search ..... 439/188; 200/51.04, 51.1
See application file for complete search history.

(56) References Cited

U.S. PATENT DOCUMENTS 6,811,419 B2 * 11/2004 Bure ..... 439/188
7,247,791 B2 * 7/2007 Kulpa ..... 174/50
7,430,601 B2 * 9/2008 Ayyagari et al. ..... 709/225
2001/0016439 A1 * 8/2001 Otsu ..... 439/188

* cited by examiner

*Primary Examiner*—Javaid Nasri
(74) *Attorney, Agent, or Firm*—Roy Kiesel

(57) ABSTRACT

A micro-switch monitored, single-pole connector is disclosed. The micro-switch is mounted to the body of the connector. The micro-switch plunger and the end of an actuating member are enclosed in a sealed chamber, thus protecting these components from debris. The connector may be a panel-mounted model or a cable-to-cable model. A standard type connection, such as a buss bar connection, is provided at the axial end of the connector.

20 Claims, 4 Drawing Sheets

MICRO SWITCH POWER CONNECTOR

BACKGROUND AND SUMMARY OF INVENTION

High power, single-pole connectors are used in a variety of industrial settings, including entertainment (e.g., outdoor concerts and carnivals), the oilfield (e.g., on remote drilling platforms), and others. These connectors may be rated for extremely high voltage and current. Safety is paramount in these settings.

Control systems are becoming increasingly common in these settings to monitor the electrical connections. Such a control system may provide input to an operator or to an automated control system. That input may include the connection status of various single-pole connectors used in the system. Some means must be employed to detect when a connection is properly made up in order to provide the proper information to the control system.

Micro switches operated by mechanical plungers provide a workable means for monitoring the connection status of this type of connector. Prior art connectors have used micro switches for this purpose. These micro-switch fitted connectors are a workable solution, but they have drawbacks, as well.

One somewhat common application for micro-switch monitored or controlled connectors is in a power supply panel. Such a panel may include a number of single-pole panel mount receptacles, such as a female, single-pole receptacle. In a typical panel-mount female receptacle, a male cable-end connector is inserted into the female receptacle. An actuator rod of some type may be fitted within the female receptacle. The male plug may push the actuator rod back as the male is inserted into the female receptacle. The actuator rod extends out the back end (i.e., the end located behind the panel) of the panel-mount female receptacle when the rod is pushed back by the male plug.

A micro-switch may be mounted to the rear end of the panel-mount assembly. The plunger of the micro-switch is then activated when the actuator rod is pushed past the end of the panel-mount connector assembly, thus activating the micro-switch. In this way, the micro-switch indicates when the connection is fully made up.

This design, however, requires that the actuator rod extend out of the panel-mount assembly. This can be problematic in practice because these connectors tend to be used in extreme conditions. Dust, dirt, mud, grease, oil, or other debris may foul the opening at the end of the panel-mount assembly. Such debris may prevent proper operation or may lead to wear of the actuator rod, the micro-switch plunger or both. It would be desirable to provide a micro-switch monitored panel-mount connector in which the actuator rod assembly and the micro-switch plunger are sealed from outside contaminants and debris.

The prior art design also tends to be vulnerable to vibration, which can alter the alignment of the actuator rod to plunger contact. Mounting a micro-switch in a more stable manner would reduce vibration-related problems.

There is yet another drawback to the prior art design when used with panel-mount connectors. It is desirable to use a buss bar type of connection on the rear, power supply side of a panel. Connections of this type of commonly used and provide a sure and solid contact. They are easy to make up and to remove, when needed. A buss bar connector, however, cannot be readily used when an actuator rod and micro-switch are mounted at the axial end of the panel-mount assembly, because that is where the buss bar, or other standard-type connection, would otherwise be located.

The present invention provides a micro-switch monitored, panel-mount connector assembly that avoids the drawbacks noted above. The invention, in one preferred embodiment includes a female panel-mount receptacle with an internal actuator rod assembly. A micro-switch is mounted laterally to the body of the connector at a point between the panel and the rear axial end of the connector. This provides a stable, secure mounting arrangement that leaves the axial end of the connector assembly unobstructed. A buss bar connection may be provided. The actuator rod assembly is fully internal to the connector assembly and may be fully sealed from the external elements. In addition, the actuator rod may provide a cam surface contacting the plunger to reduce the play or slop in the system, thus improving overall performance. These and other benefits of the invention will become more clear through the description set forth below.

DETAILED DESCRIPTION OF PREFERRED EMBODIMENTS OF THE INVENTION

Figure 1:
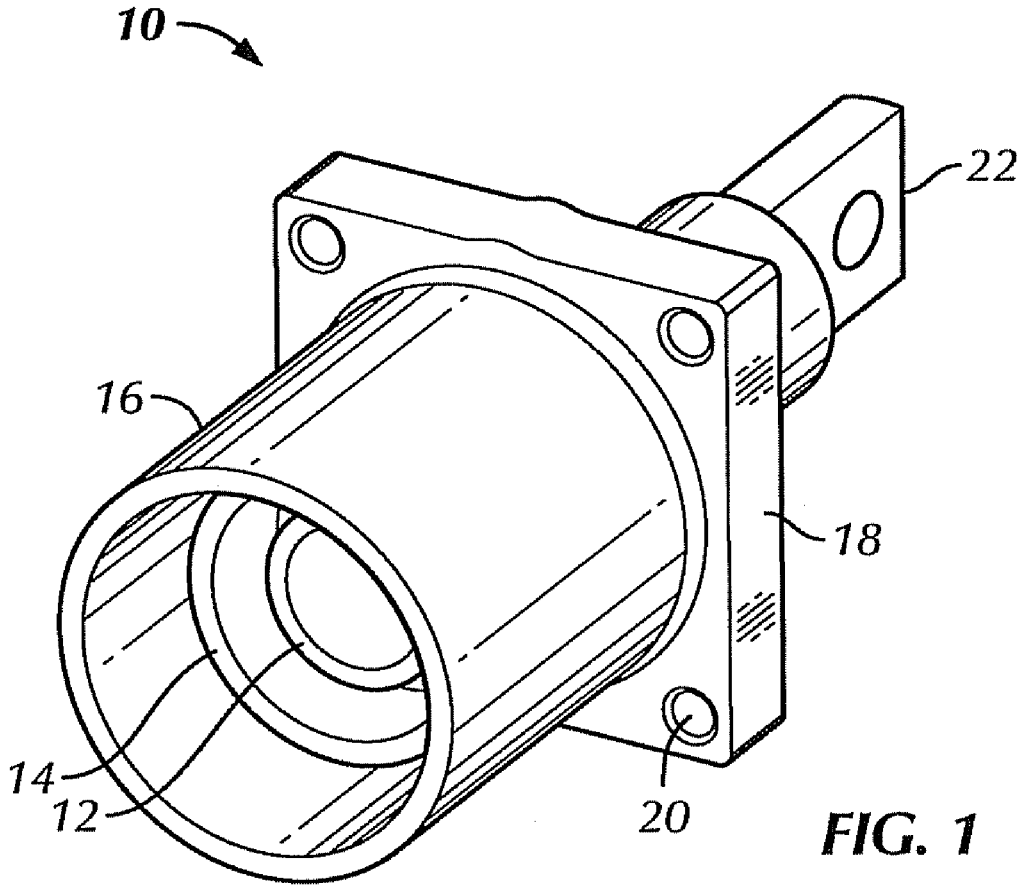
FIG. 1 is a perspective view of a female, panel-mount, single-pole connector.

FIG. 1 shows a panel-mount connector 10 of the general type used with the current invention. The connector 10, as shown in FIG. 1, does not incorporate the invention, but shows some of the key parts of the general connector. The connector 10 has an internal female receptacle 12, which is surrounded by an open area. Moving radially outward, a cylindrical insulator layer 14 is shown, just inside the rigid outer shell 16. The connector 10 is secured to a panel by a panel mounting plate 18 that is bolted to the panel through panel mounting bolt holes 20.

The connector 10 has a buss bar connection 22 at end of the connector that will be located behind the panel. The buss bar connection 22 is a desirable feature. This type of connection is widely used, so operators are familiar with it, basic tools are used to make or break such a connection, and parts are likely to be readily available. The buss bar connection 22 can be somewhat difficult to insulate. This issue, however, is much less of a concern when the connection is behind a panel, because such areas are not typically accessible during operations. Providing a standardized connection like a buss bar connection on the end of the connector to be located behind the panel is a highly desirable feature.

The benefit described above is attributable to the fact that a standardized connection may be used with the improved connector of the present invention. The buss bar is just one such connection. A threaded shaft connection, designed for use with an eyelet or ring connector crimped to a power cable, could also be used. Other common connections are also possible. This benefit derives from the mounting of the micro-switch on the body of the connector, rather than on the axial end of the connector. By leaving the axial end of the connector unobstructed, it is possible to use any desired type of standard connection at that location. This is beneficial because of the standardization benefits, but also because the connection can be made up and disconnected without removing the micro-switch, and while reducing the risk of physical damage to the micro-switch (i.e., by mounting it in a position that is not in the way when an operator works on the axial end connection).

Figure 2:
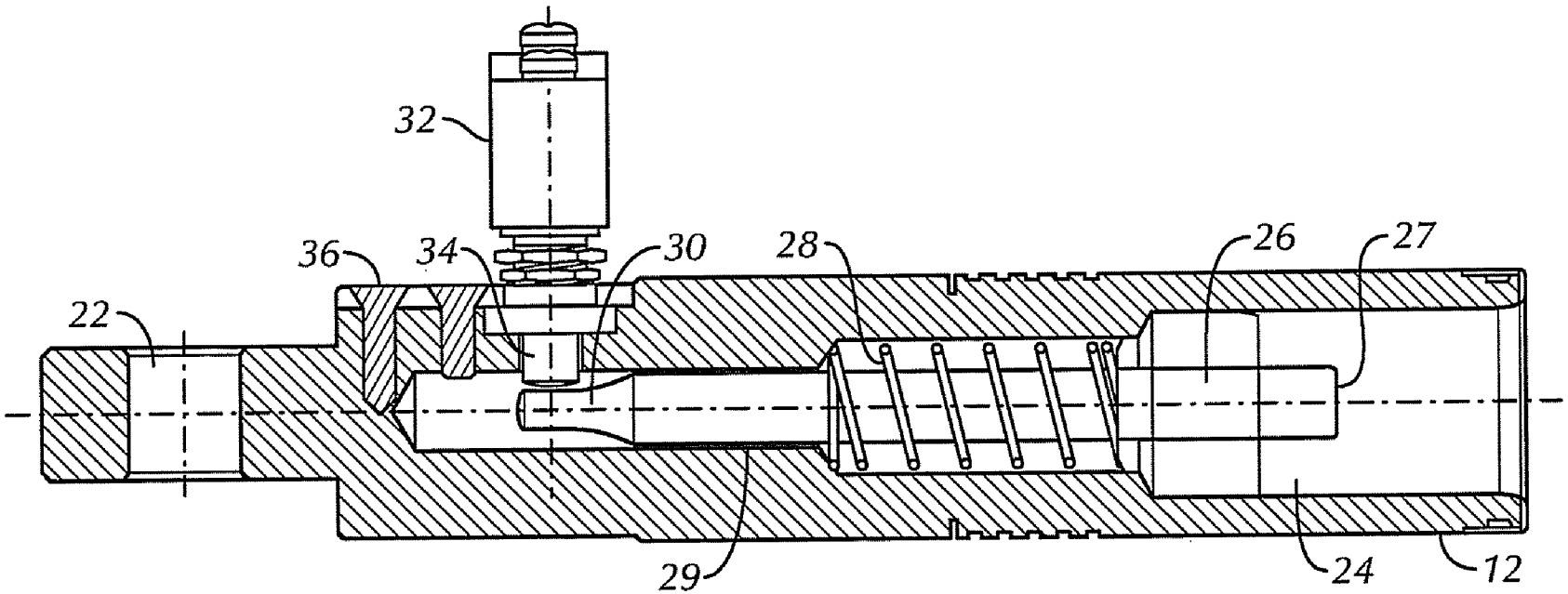
FIG. 2 is a cross-sectional side view of a preferred embodiment of the present invention.

FIG. 2 shows a cross-sectional, side view of the internal portions of a female, panel-mount, connector embodying the present invention. The female receptacle 12 is shown near the right-hand side of the drawing and is configured to receive an electrical plug. In this embodiment, the receptacle is configured to receive a male, cable-end plug. At the opposite end, a buss bar connection 22 is provided. The internal electrical contact region 24 is the area filled by a male, cable-end plug when a full connection is made up. The male plug is not shown, but is well understood by those with skill in the art.

An actuator member 26 is positioned axially within the body of the connector. The actuating member 26 is shown as a rod in FIG. 2, but could take other forms. For example, a male, panel-mount receptacle might use a cylindrical actuating member. An elongated pin could be used, as well. In the embodiment shown in FIG. 2, a plunger end 27 of the actuating member 26 extends a short distance into the rear portion of the internal electrical contact region 24 of the female receptacle 12. When a male plug is fully inserted into the female connector, the male connector will push the plunger end 27 and thus the entire actuator rod 26 back into the body of the female connector. The actuator rod 26, as shown in FIG. 2, would move to the left when a male plug is fully inserted into the female receptacle 12. A bias spring 28 is used to bias the actuator rod 26 into the position shown in FIG. 2, that is, with the plunger end 27 of the actuator rod 26 extending into the internal electrical contact region 24. The bias spring 28 provides enough force to keep the actuator rod 26 in this position when no male plug is inserted, but the bias spring 28 does not provide substantial resistance to the insertion of a male plug into the female receptacle 12.

The actuator rod 26 passes through a sealing passage 29 which is sized to closely match the outer diameter of the actuator rod 26. Enough clearance is allowed so that the actuator rod 26 may freely travel axially within the passage, but the clearance is sufficiently tight to provide an effective mechanical seal. This seal keeps debris from entering the region of the connector that houses the micro-switch 32.

The rear end of the actuator rod 26 (i.e., the left end in FIG. 2) has a cam surface 30 in the illustrated embodiment. The cam surface 30 may be desirable, as it may reduce play between the cam surface 30 and the plunger 34 of the micro switch 32. Other types of actuating surfaces, however, also may be used. A straight bevel may be used, for example, with much the same benefits. The cam surface 30 acts to move the plunger 34 of the micro switch 32 when the actuator rod 26 is forced back by the insertion of a male plug into the female receptacle 12.

By using a cam or bevel surface, and keeping the actuating member in contact with the plunger 34, a zero lash arrangement is provided. This configuration increases the accuracy of the micro-switch monitoring provided by the invention. It also may reduce wear between the actuating member 26 and the plunger 34. This configuration also helps control the velocity of the plunger 34, which in turn helps control the velocity of the electrical contacts within the micro-switch 32, which may help extend the life of the switch.

Figure 5:
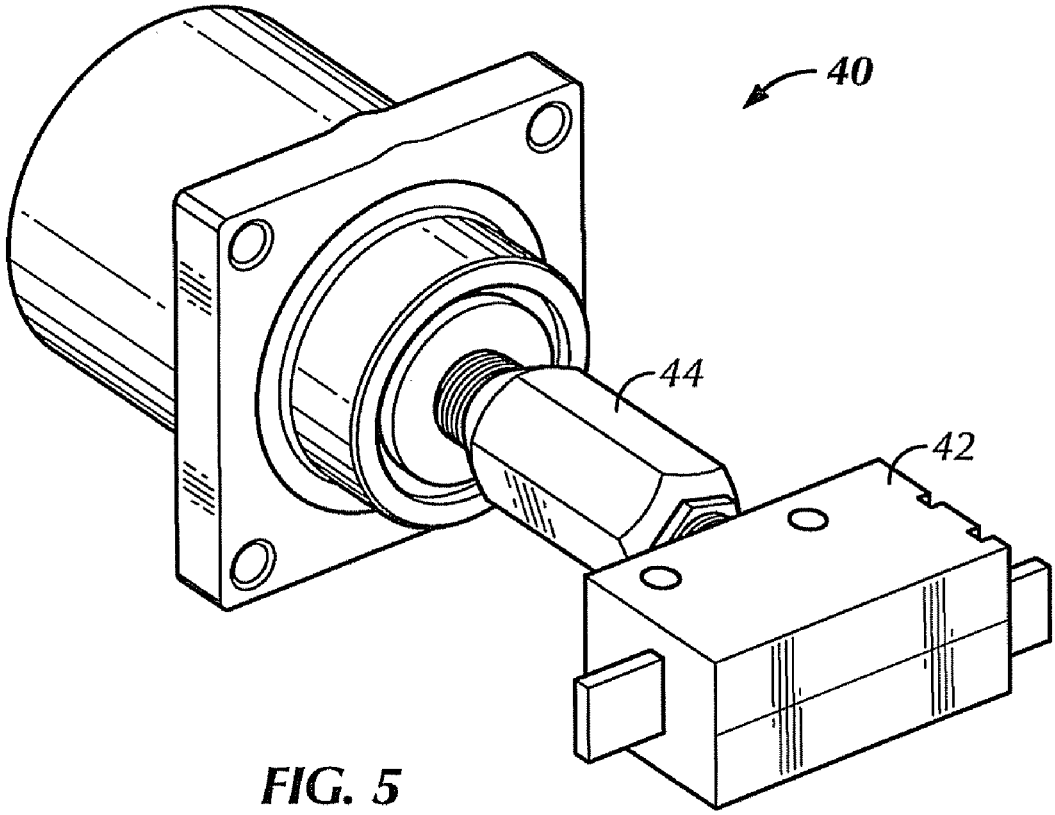
FIG. 5 (Prior Art)
FIG. 5 is a perspective view of a prior art connector.

The micro-switch 32 is mounted to the body of the connector between the mounting panel and the rear connector surface, which is shown as a buss bar contact 22 in FIG. 2. This mounting provides a stable location that is less prone to vibration than a micro-switch mounted to the axial end of the connector (e.g., as shown in FIG. 5). The micro-switch 32 is provided a solid, secure mounting surface, and can be secured using mounting screws 36. By mounting the micro-switch 32 to a mounting plate, rather than threading it into the axial end of the connector, field replacement of the micro-switch is facilitated. In addition, field replacement of a micro-switch in the present invention may be accomplished without post-installation adjustment of the micro-switch.

FIG. 2 does not show the entire single pole connector. When the full connector is mounted to a panel, the panel will be positioned roughly at the location of the bias spring 28.

This arrangement provides important benefits. The micro-switch 32 is more stable and less prone to vibration than in the prior art design, as explained above. The micro-switch plunger 34 and the actuating surface 30 of the actuating rod 26 are both located in a sealed area within the connector body. This is quite different than the prior art micro-switch controlled connector 40, shown in FIG. 5. In the prior art design, either the actuating surface of the actuator rod, the micro-switch plunger, or both must extend out of the body of the connector and switch. This exposes these parts to dust, debris, salt-water vapor, and other detrimental materials. Such exposure can be damaging, given that these contact surfaces do not typically have large tolerances. Wear, coupled with increased vibration, can lead to failures. Seized micro-switch plungers or actuator rods are possible with the prior art design. The sealed chamber design of the present invention avoids such problems.

Though a number of micro-switch designs are expected to work well with the present invention, one particular product that works in this setting is the Omron Z-15GQ-B7-K plunger-activated switch. This switch may be mounted to the body of a panel-mount connector as described above.

Figure 3:
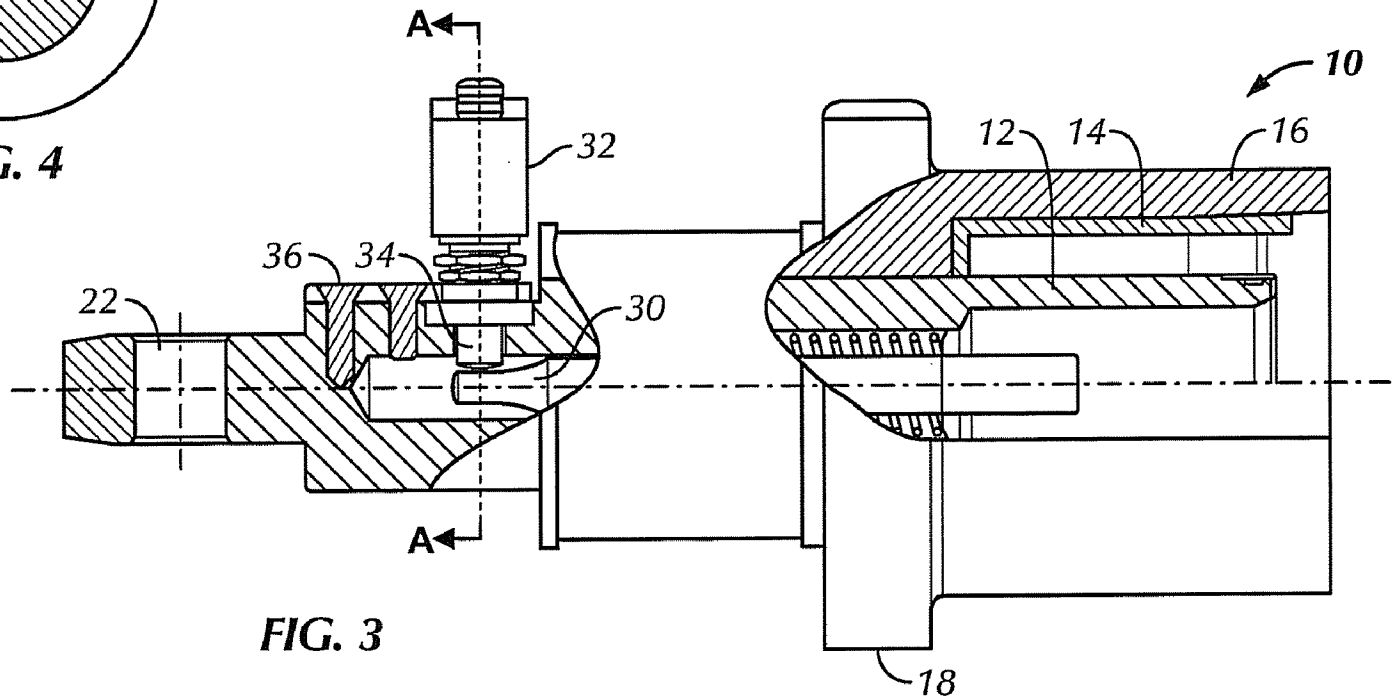
FIG. 3 is a cut-away view of a preferred embodiment of the present invention.
Figure 4:
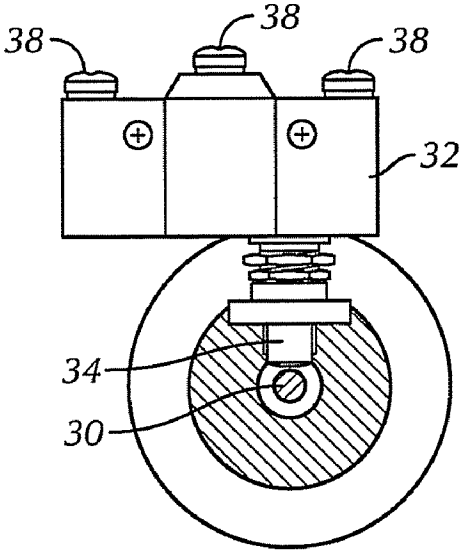
FIG. 4 is a cross-sectional end view of a preferred embodiment of the present invention.

FIGS. 3 and 4 provide additional views of the invention. In FIG. 3, the panel-mount connector 10 is shown in partial cut-away form. The female receptacle 12, insulator layer 14, and outer shell 16 are shown on the working side of the connector, that is, the side that will be outside the panel when the connector is installed. The panel mounting plate 18 is used to secure the connector 10 to an electrical supply panel in an industrial setting.

Panel mounted single-pole connectors of the general type used with the present invention may be described as having a power supply end and a working end. This nomenclature is based on the typical configuration, in which the connector is mounted to a power supply distribution panel. One side of the distribution panel is enclosed, and thus isolated from workers, once the connections are made up and the system energized. This side of the panel contains the incoming power supply cables. The connections made on this side of the panel—which can be described as the back side or inside of the power distribution panel—are referred to as the power supply side connections. The end of the single-pole connector configured to be positioned on this side of the panel is referred to as the power supply side or power supply end of the connector. For the reasons explained above, it is desirable to provide a buss bar, or other standardized connection, on the power supply end of the panel-mount single-pole connector.

A buss bar connection, for example, is relatively easy for an operator to make up in the field. Once the power supply side connections are made up, the power supply side of the distribution panel may be secured, thus isolating the entire area from workers. Alternatively, the power supply side may remain open, but deenergized, until the micro-switch monitored connectors indicate that all connections are fully made up. Once this status is confirmed, the power supply side of the panel is secured, and then, the system is energized.

The opposite side of the panel, and the opposite end of the single-pole connector, may be referred to as the working side.

On a typical panel-mount connector of the type used with the present invention, a receptacle is provided on the working end. The receptacle may be either male or female. A cable-end plug of the opposite polarity is inserted into the receptacle to complete the connection. When the cable-end connector is fully inserted into the panel-mount receptacle, the micro-switch will indicate that the connection is fully and properly made up. When all the panel mounted connectors show complete and proper connections, the power supply side of the panel may be secured, and the power system energized.

The power supply end and working end references described herein clearly distinguish between the two electrical connections provided on a single-pole connector of the type used with the present invention. It is important to understand that these references are based on the typical positioning and use of the connectors in the field. In other words, when one part of the connector is identified as the power supply end, that reference does not mean the connector has been installed in a power distribution panel. It is merely a means of identifying the physical part of the connector that likely would be positioned on the power supply side of a distribution panel in use. The connector need not actually be installed to have a power supply end and a working end. These are merely labels for identifying the physical parts or sections of the connector.

The micro-switch 32 is mounted to the body of the connector 10, as shown in FIG. 3. The micro-switch 32 is positioned near a mid-point between the panel mounting plate 18 and the axial end of the connector where the buss bar 22 is shown in FIG. 3. The precise positioning of the micro-switch 32 is not critical. What is important is that the plunger 34 of the micro-switch 32 and the actuating surface 30 of the actuating member 26 come into contact within a chamber. By necessity, this chamber must be positioned at a between the panel mounting plate 18 and the buss bar connection 22. Positioning the micro-switch 32 near the mid-point is desirable because it provides some working clearance on all sides of the micro-switch 32, which may facilitate making up the contacts to the micro-switch 32, and may make field replacement of the micro-switch 32 easier in the event of a failure.

The left-hand region of FIG. 3 (i.e., the power supply side) shows the end of the operating chamber of the present invention. The actuating surface 30 of the actuator rod 26 is shown in contact with the plunger 34 of the micro-switch 32. The switch 32 is secured with mounting screws 36. By using a cam surface or other tapered surface for the actuating surface 30, the actuator rod 26 is always engaged with the micro-switch plunger 34. This eliminates play between these components and increases precision and reliability.

A buss bar connection 22 is shown at the left end of FIG. 3. This type of connection is possible when using the present invention, because the micro-switch 32 is mounted on the side of the body of the connector 10, rather than at the axial end of the connector (as shown in FIG. 5). Providing a buss bar connection 22 is a desirable feature.

FIG. 4 is a cross-section, taken along line A-A of FIG. 3. This cross-section shows the actuator surface 30 of the actuator rod 26 in contact with the plunger 34. The micro-switch 32 has contacts 38, which are typically connected to some monitoring or control system.

FIG. 5 shows a prior art micro-switch controlled connector 40. The prior art micro-switch 42 is shown connected to the axial end of the connector 40. The actuator rod in this design must extend out the rear end of the connector body, or the plunger of the micro-switch must extend into the rear end of the connector body. This aspect of the prior art design is not illustrated in FIG. 5, but is simple to understand. This arrangement exposes one of both of these components to the elements.

The axial mounting also increases the vibration effects felt by the micro-switch. These are often less rugged components than the connectors, and for that reason, the intense vibration sometimes present in industrial settings may lead to failures of micro-switches used in the prior art design shown in FIG. 5.

The end mounting of the prior art design shown in FIG. 5 also prevents use of a buss bar type of contact. The prior art design has a contact 44 between the micro-switch and the panel. This type of connection is more difficult to use than the buss bar connection shown in the prior drawings, and therefore may be less desirable.

In operation, the micro-switch may be used for monitoring, control, or some combination. For example, a control system, either automated or by manual operation, may check the status of the micro-switches for all the connectors in a particular panel. Only when the micro-switches indicate that every connection has been made up will the panel be energized. This is but one possible application of the present invention for control and monitoring of the status of electrical connections.

The present invention may be used with male or female panel-mount connectors. The drawings illustrate a female connector, but the invention is not dependant upon whether the connector is male or female. In a male, panel-mount connector, the actuator rod 26 may simply extend out past the tip of the male electrical contact, so that the back end of a female, cable-end plug will push the actuator rod back, in the same way described above. By using a sealing passage 29 within the body of the connector, the working region of the invention (i.e., the area with the micro-switch 32 and the actuating end 30 of the actuator rod 26) is effectively sealed from the environment.

Variations on the actuator rod 26 are also possible. In a male connector, for example, there typically is an open area between the male contact surface and its insulator. This is the area filled by the female connector when a full connection is made up. A cylindrical sleeve operatively connected to an actuator rod could be used, where the sleeve is positioned in the open space between the male contact surface and its insulator. Thus, when a female, cable-end connector is inserted into the male, panel-mount connector, the cylindrical sleeve would be pushed back, thus moving the actuator rod back, in much the same manner that was described above.

The description provided above, and the drawings, show a typical panel-mount connector embodying the present invention. The invention, however, is not limited to such a configuration. The micro-switch monitored connector of the invention may be used in a variety of applications. For example, with little or no variation from the description provided above, the connector could be used for connections to machines, drive motors, and other large equipment. Such equipment may have a panel or other mounting surface upon which the panel-mount connector described above could be secured. Any suitable mounting surface for a panel-mount connector should be understood as a panel, as that term is used herein. The power supply side, as described above, would then become the internal side of the mounting surface (i.e., inside the machine, drive motor, or other piece of equipment). The working side with the receptacle would be positioned on the outside of the equipment, and a cable-end plug would be inserted into the receptacle.

When used in this manner, the present invention may allow an operator or a control system to determine when the power connections to a key piece of equipment have been fully made up. For example, if the present invention is used with the connections to a large electric drive motor in an oilfield application, the invention would enable an operator to ensure that all connections—that is, the connections at the power distribution panel and the connections at the drive motor—are fully made up before the system is energized. This use of the present invention may provide important safety benefits.

The present invention also may be used with cable-to-cable connections. In this application, there is no panel mounting hardware and there typically are not buss bar connections. Instead, each cable-end connector typically has a fully insulated, crimped-on connection from the cable to the connector. The other end of the connectors are of the same receptacle and plug type described above. In this application, a micro-switch may be mounted to the body of a cable-end receptacle connector in the same manner as was described above. When the mated, cable-end plug is fully inserted into a micro-switch fitted cable-end receptacle, the micro-switch will indicate that the cable-to-cable connection is properly made up.

It may be desirable to enclose the micro-switch in a protective housing when the present invention is used in a cable-to-cable application, because such connections do not provide the inherent protections found on the power supply side of a distribution panel, as explained above. Additional control wiring also may be needed to run from the micro-switch to the control or monitoring system. These additions are minor variations on the embodiments of the invention described above, and are well within the capabilities of a person with ordinary skill in the art.

The present invention may be used in a variety of contexts. Connectors of this type may be quite beneficial in the oilfield industry, where very high-power single pole connectors are widely used. Carnivals also use relatively high-power electrical connectors that must be made up and disconnected on a regular basis as the carnival moves from one location to another. Large outdoor concert equipment, including sound and lighting gear, may benefit from the present invention. Temporary lighting systems used at outdoor worksites, such as large road construction sites, may also benefit from use of the present invention.

These and other variations on the described embodiments are well within the scope of the skill in the art. While the preceding description is intended to provide an understanding of the present invention, it is to be understood that the present invention is not limited to the disclosed embodiments. To the contrary, the present invention is intended to cover modifications and variations on the structure and methods described above and all other equivalent arrangements that are within the scope and spirit of the following claims.

I claim:

1. A panel-mount, single-pole electrical connector comprising:

a. a working end configured to be positioned on a working side of a panel, the working end having a receptacle configured to receive an electrical plug;

b. a power supply end configured to be positioned on a power supply side of the panel, the power supply end having a standard electrical contact;

c. a panel mounting surface positioned between the working end and the power supply end, the panel mounting surface configured to enable the connector to be securely mounted to the panel;

d. a sealed chamber within the connector, the sealed chamber positioned near a mid point between the panel mounting surface and the power supply end of the connector;

e. an actuating member extending from the receptacle into the sealed chamber; and, f. a micro-switch secured to the connector such that a plunger of the micro-switch extends into the sealed chamber and is in operative contact with the actuating member, such that insertion of an electrical plug into the receptacle results in movement of the micro-switch plunger.

2. The connector of claim 1, wherein the standard electrical contact on the power supply end is a buss bar contact.

3. The connector of claim 1, wherein the receptacle on the working end is a female receptacle.

4. The connector of claim 1, wherein the receptacle on the working end is a male receptacle.

5. The connector of claim 1, wherein the connector is configured for installation in an electrical power distribution panel.

6. The connector of claim 1, wherein the connector is configured for installation is an electrical component.

7. The connector of claim 1, wherein the power supply end of the connector is configured to be physically isolated from personnel when the connector is energized.

8. The connector of claim 1, wherein the actuating member has a cam surface in contact with the micro-switch plunger.

9. The connector of claim 1, wherein the actuating member is a rod.

10. The connector of claim 9, further comprising a bias spring.

11. The connector of claim 1, wherein the micro-switch is secured to a mounting plate such that the micro-switch is readily field replaceable.

12. The connector of claim 1, wherein the micro-switch plunger and the actuating member are positioned to allow for a zero lash adjustment of the micro-switch.

13. A single-pole electrical connector comprising:

a. a working end having a receptacle configured to receive an electrical plug;

b. a power supply end;

c. an actuating rod extending axially from within the receptacle to a chamber located within the connector;

d. a micro-switch secured to a mounting plate on the connector, the micro-switch having a plunger that extends radially into the chamber, wherein the plunger is in operative contact with the actuating rod such that insertion of an electrical plug into the receptacle results in axial movement of the actuating rod, radial movement of the plunger and actuation of the micro-switch.

14. The connector of claim 13, wherein the connector is a panel-mount connector.

15. The connector of claim 13, wherein the receptacle is a female receptacle.

16. The connector of claim 13, wherein the actuating rod has a cam surface in contact with the micro-switch plunger.

17. The connector of claim 13, wherein the micro-switch is field replaceable.

18. A single-pole connector, comprising:

a. a working end having a receptacle configured to receive an electrical plug;

b. a cable end opposite the working end, the cable end being connected to an electrical power cable and covered by electrically insulating material;

c. a sealed chamber within the connector, the sealed chamber positioned near a mid point between the working end and the cable end of the connector;

d. an actuating member extending from the receptacle into the sealed chamber, such that insertion of an electrical plug into the receptacle results in axial movement of the actuating member; and, e. a micro-switch secured to the body of the connector such that a plunger of the micro-switch extends into the sealed chamber and is in operative contact with the actuating member.

19. The connector of claim 18 further comprising a protective housing positioned around the micro-switch.

20. The connector of claim 18 wherein the actuating member has a cam surface in contact with the micro-switch plunger.

* * * * *